US008810135B2

(12) United States Patent
Maruyama et al.

(10) Patent No.: US 8,810,135 B2
(45) **Date of Patent: *Aug. 19, 2014**

(54) LED DRIVE CIRCUIT, LED ILLUMINATION COMPONENT, LED ILLUMINATION DEVICE, AND LED ILLUMINATION SYSTEM

(75) Inventors: Yasuhiro Maruyama, Osaka (JP); Hiroyuki Shoji, Osaka (JP); Mitsuru Mariyama, Osaka (JP); Masakazu Ikeda, Osaka (JP); Hirohisa Warita, Osaka (JP); Katsumi Inaba, Osaka (JP); Naoki Fukunaga, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 46 days.

This patent is subject to a terminal disclaimer.

(21) Appl. No.: 13/567,622

(22) Filed: Aug. 6, 2012

(65) Prior Publication Data

US 2013/0026946 A1 Jan. 31, 2013

Related U.S. Application Data

(62) Division of application No. 12/539,241, filed on Aug. 11, 2009, now Pat. No. 8,258,706.

(30) Foreign Application Priority Data

Oct. 9, 2008 (JP) ..... 2008-263228

(51) Int. Cl.
*H05B 37/00* (2006.01)
*H05B 41/00* (2006.01)

(52) U.S. Cl.
USPC ..... 315/119; 315/125; 315/127; 315/291

(58) Field of Classification Search
None
See application file for complete search history.

(56) References Cited

U.S. PATENT DOCUMENTS

| | | | | |
|---|---|---|---|---|
| 6,057,651 | A | 5/2000 | Usami | |
| 7,180,921 | B2 * | 2/2007 | Mangano et al. | 372/38.02 |
| 8,258,706 | B2 * | 9/2012 | Maruyama et al. | 315/119 |
| 2006/0192728 | A1 | 8/2006 | Kim | |
| 2007/0182338 | A1 * | 8/2007 | Shteynberg et al. | 315/200 R |
| 2008/0012507 | A1 | 1/2008 | Nalbant | |
| 2008/0150450 | A1 | 6/2008 | Starr et al. | |
| 2008/0258647 | A1 | 10/2008 | Scianna | |
| 2009/0102399 | A1 | 4/2009 | Kita | |
| 2010/0219764 | A1 | 9/2010 | Yamasaki et al. | |
| 2012/0139431 | A1 | 6/2012 | Thompson et al. | |

FOREIGN PATENT DOCUMENTS

| | | | |
|---|---|---|---|
| CN | 101513122 | A | 8/2009 |
| JP | 3-285289 | A | 12/1991 |
| JP | 5-66718 | A | 3/1993 |
| JP | 10-250579 | A | 9/1998 |
| JP | 2000-173304 | A | 6/2000 |

(Continued)

*Primary Examiner* — Anh Tran

(74) *Attorney, Agent, or Firm* — Birch, Stewart, Kolasch & Birch, LLP

(57) ABSTRACT

An LED drive circuit is an LED dive circuit that receives an alternating voltage to drive an LED, and includes a current remove portion that removes a current from a current supply line that supplies an LED drive current to the LED. If an input current to the LED drive circuit is an unnecessary current, the LED does not light because of current removal by the current remove portion. If the input current to the LED drive circuit turns into the LED drive current from the unnecessary current, the current remove portion decreases the amount of current removed.

5 Claims, 15 Drawing Sheets

(56) References Cited

FOREIGN PATENT DOCUMENTS

| | | | |
|---|---|---|---|
| JP | 2001-215913 | A | 8/2001 |
| JP | 2003-151782 | A | 5/2003 |
| JP | 2004-296205 | A | 10/2004 |
| JP | 2005-11739 | A | 1/2005 |
| JP | 2006-319172 | A | 11/2006 |
| JP | 2007-227155 | A | 9/2007 |
| JP | 2007-538378 | A | 12/2007 |
| JP | 2009-43694 | A | 2/2009 |
| JP | 2009-104848 | A | 5/2009 |
| JP | 2009-123681 | A | 6/2009 |
| JP | 2009-238525 | A | 10/2009 |
| JP | 2011-003467 | A | 1/2011 |
| KR | 10-2006-0098345 | A | 9/2006 |
| KR | 2008-0047521 | A | 5/2008 |

* cited by examiner

LED DRIVE CIRCUIT, LED ILLUMINATION COMPONENT, LED ILLUMINATION DEVICE, AND LED ILLUMINATION SYSTEM

This application is a divisional of U.S. patent application Ser. No. 12/539,241 filed Aug. 11, 2009, now U.S. Pat. No. 8,248,706 which claims priority under 35 U.S.C. §119 (a) on Patent Application No. 2008-263228 filed in Japan on Oct. 9, 2008, the entire contents of which are hereby incorporated by reference.

BACKGROUND OF THE INVENTION

1. Field of the Invention

The present invention relates to an LED (Light-Emitting Diode) drive circuit that drives an LED, and to an LED illumination component, an LED illumination device and an LED illumination system that use an LED as a light source.

2. Description of the Related Art

An LED has features of a low current consumption, a long life and the like, and is spreading its applications not only to display devices but also to illumination devices and the like. In illumination apparatuses, to obtain a desired illumination, a plurality of LEDs are often used.

A general illumination apparatus often uses a commercial 100 VAC power source, and considering a case and the like where an LED illumination component is used instead of a general illumination component such as an incandescent lamp or the like, it is desirable that like a general illumination component, an LED illumination component also has a structure to use a commercial 100 VAC power source.

Besides, to perform light control of an incandescent lamp, a phase-control light controller (generally called a incandescent light controller) is used, which is able to easily perform light control so as to control power supply to the incandescent lamp with only a volume element by turning on a switching element (generally, a TRIAC element) at a phase angle of an alternating-current power source voltage.

To perform light control of an LED illumination component that uses an alternating-current power source, usually, a phase-control light controller is used as in a case where light control of an incandescent lamp is performed. Here, a conventional example of an LED illumination system that is able to perform light control of an LED illumination component that uses an alternating-current power source is shown in FIG. 19

The LED illumination system shown in FIG. 19 includes: a phase-control light controller 2; an LED drive circuit 101; and an LED module 3. The phase-control light controller 2 is connected between and in series with an alternating-current power source 1 and the LED drive circuit 101. If a light-control knob (not shown) of a control circuit CNT1 is set to a predetermined position, the phase-control light controller 2 turns on a TRIAC Tra1 at a power-source phase angle that corresponds to the set position. Besides, in the phase-control light controller 2, a noise prevention circuit is composed of a capacitor C1 and an inductor L1 and reduces terminal noise that is returned from the phase-control light controller 2 to the power-source line.

In the LED illumination system shown in FIG. 19, when the TRIAC Tra1 is in an off state, power supply from the alternating-current power source 1 to the LED drive circuit 101 should be cut off; however, the alternating-current power source 1 and the LED drive circuit 101 are always connected to each other by the capacitor C1 of the noise prevention circuit of the above phase-control light controller 2. Accordingly, even if the TRIAC Tra1 is in the off state, a current is supplied to the LED as shown in FIGS. 20A and 20B. Here, in FIGS. 20A and 20B, $V_{IN2}$ is an input voltage waveform to the phase-control light controller 2; $V_{OUT2}$ is an output voltage waveform from the phase-control light controller 2; and $I_3$ is a current waveform that flows in the LED module 3.

Because the TRIAC Tra1 of the phase-control light controller 2 is in the off state, only a leakage current that flows through the capacitor C1 is supplied to the LED drive circuit 101, so that a current limiting circuit of the LED drive circuit 101 does not operate; however, there is a problem that the LED module 3 is turned on by the leakage current and slightly emits light. Besides, because the LED module 3 is slightly lighting because of the leakage current that flows through the capacitor C1, a forward voltage $V_F$ is generated in the LED module 3; accordingly, in FIG. 20A, a rising voltage of the TRIAC Tra1 is delayed, and a time span in which a drive current is supplied to the LED module 3 becomes short, so that a problem arises that the LED module 3 becomes dim and the light control range becomes narrow.

Besides, as another conventional example of the LED illumination system that is able to perform light control of an LED illumination component which uses an alternating-current power source, as shown in FIG. 21, there is an LED illumination system that includes a phase-control light controller 2' that has a firefly lighting function with a neon lamp. Here, in FIG. 21, the same parts as those in FIG. 19 are indicated by the same reference numbers and the explanation of them is skipped.

In the LED illumination system shown in FIG. 21, a series circuit (hereinafter, called a firefly circuit) of a neon lamp NL1 and a current limiting resistor Re1 is connected in parallel with the TRIAC Tra1; if the TRIAC Tra1 is selected by an external switch S1 to supply an LED drive current to the LED module 3, the neon lamp NL1 is turned off; if the firefly circuit is selected by the switch S1 not to supply the LED drive current to the LED module 3, electricity is supplied to the firefly circuit to indicate where the phase-control light controller 2' is. As in the LED illumination system shown in FIG. 21, even if the capacitor C1 of the noise prevention circuit is not connected in parallel with the TRIAC Tra1, a slight current is supplied to the LED drive circuit 101 via the firefly circuit when the TRIAC Tra1 is in the off state; accordingly, a problem arises that the LED module 3 slightly emits light and the rising voltage of the TRIAC Tra1 is delayed.

Here, as a solution to the above problems, a solution is known, in which as shown in FIG. 22, a leakage current that flows in the LED module 3 is curbed by connecting an impedance Z1 (a resistor, a capacitor, a neon lamp or the like) in parallel with a power input portion of an LED drive circuit 102 (e.g., JP-A-2004-296205). However, in the structure shown in FIG. 22, a current $I_{Z1}$ (=an input power-source voltage $V_{Z1}$/an impedance value $Z_{Z1}$ of the impedance Z1) flows through the impedance Z1 even for a time the TRIAC Tra1 is turned on and input power is supplied to the LED drive circuit 102. Accordingly, a problem arises that the power loss is large and the power efficiency decreases.

SUMMARY OF THE INVENTION

It is a first object of the present invention to provide an LED drive circuit, an LED illumination component, an LED illumination device, and an LED illumination system that are able to prevent an unnecessary lighting of an LED from occurring and is high in power efficiency.

It is a second object to provide an LED illumination component, an LED illumination device, and an LED illumination system that are able to prevent an unnecessary lighting of an LED from occurring.

To achieve the above first object, an LED drive circuit according to the present invention is an LED drive circuit that receives an alternating voltage to drive an LED, and includes a current remove portion that removes a current from a current supply line that supplies an LED drive current to the LED. If an input current to the LED drive circuit is an unnecessary current, the LED does not light because of current removal by the current remove portion. If the input current to the LED drive circuit turns into the LED drive current from the unnecessary current, the current remove portion decreases the amount of current removed. Here, the unnecessary current means a current that can be supplied to an LED and is unnecessary to the LED for a time span in which it is necessary to keep the LED from lighting; the LED drive current means a current that is supplied to an LED for a time span in which it is necessary to keep the LED lighting.

According to this structure, if the input current to the LED drive circuit according to the present invention is an unnecessary current, the LED does not light because of the current removal by the current remove portion; accordingly, it is possible to prevent the unnecessary lighting of the LED from occurring. Besides, if the input current to the LED drive circuit turns into an LED drive current from an unnecessary current, the current remove portion decreases the amount of current removed; accordingly, it is possible to reduce the power loss and raise the power efficiency in the time the input current to the LED drive circuit according to the present invention is the LED drive current.

The current remove portion may include: a bypass line for carrying a current that is removed from the current supply line; an active element that is disposed on the bypass line; and a control portion that controls the active element. The control portion may switch the state of the active element from an on state to an off state if the input current to the LED drive circuit turns into an LED drive current from an unnecessary current.

According to this structure, if the input current to the LED drive circuit turns into an LED drive current from an unnecessary current, the active element is switched from the on state to the off state, so that it is possible to prevent a current from flowing in the bypass line. Besides, because the control portion generates a control signal for controlling the active element, the current that flows in the control portion is much smaller than the current that flows in the bypass line when the active element is in the on state. Accordingly, if the input current to the LED drive circuit turns into an LED drive current from an unnecessary current, the current remove portion of the LED drive circuit according to the present invention is able to decrease the amount of current removed.

Besides, a current limiting circuit for limiting the current that flows in the LED may be included.

A rectification circuit for rectifying the input voltage to the LED drive circuit may be included.

A voltage detection circuit for detecting the input voltage to the LED drive circuit or a voltage that is obtained by rectifying the input voltage may be included; and the control portion may control the active element in accordance with a detection result from the voltage detection circuit. Further, a structure may be employed, in which the voltage detection portion includes a plurality of divided resistors.

The control portion may include a comparator for comparing a detection result from the voltage detection portion and a set voltage and control the active element in accordance with a comparison result from the comparator. Moreover, from a viewpoint for higher power efficiency, the comparator may have a hysteresis characteristic.

The control portion may include: a first transistor a base of which is connected to an output of the voltage detection circuit; and a constant-current source or a resistor that is connected to a collector of the first transistor. And the active element may be a second transistor a base of which is connected to the collector of the first transistor.

The control portion may include: a thyristor a gate of which is connected to an output of the voltage detection circuit; and a constant-current source or a resistor that is connected to an anode of the thyristor. And the active element may be a transistor a base of which is connected to the anode of the thyristor.

The control portion may include: a first N-channel MOS transistor a gate of which is connected to an output of the voltage detection circuit; and a constant-current source or a resistor that is connected to a drain of the first N-channel MOS transistor. And the active element may be a second N-channel MOS transistor a gate which is connected to the drain of the first N-channel MOS transistor.

A current detection circuit for detecting the input current to the LED drive circuit or a current that is obtained by rectifying the input current may be included; and the control portion may control the active element in accordance with a detection result from the current detection circuit. Further, the current detection circuit may include: a current detection resistor; and an amplifier for detecting a voltage across both terminals of the current detection resistor.

The current remove portions may be separately disposed in both directions of the alternating voltage.

An external signal input portion for receiving an external signal may be included; and the control portion may control the active element in accordance with the external signal.

To achieve the above first object, an LED illumination component according to the present invention is so structured as to include; an LED drive circuit that has any one of the above structures; and an LED that is connected to an output side of the LED drive circuit.

To achieve the above second object, an LED illumination component according to the present invention is so structured as to include: an LED; and an LED lighting prevention portion that prevents the LED from lighting because of an unnecessary current. Besides, a power loss curb portion that curbs power loss caused by the LED lighting prevention portion may be included.

According to this structure, for example, in an existing illumination device and an illumination system that conventionally use illumination components such as an incandescent lamp, a fluorescent lamp and the like, it is possible to prevent the LED from lighting because of an unnecessary current by only replacing the illumination components such as the incandescent lamp, the fluorescent lamp and the like with the LED illumination component according the present invention. Besides, it is possible to improve the power efficiency by disposing the power loss curb portion that curbs power loss caused by the LED lighting prevention portion.

To achieve the above first or second object, an LED illumination device according to the present invention is so structured as to include an LED illumination component that has any one of the above structures.

Besides, to achieve the above first or second object, an LED illumination system according to the present invention includes: an LED illumination component that has any one of the above structures or an LED illumination device that has the above structure; and a light controller that is connected to an input side of the LED illumination component or of an LED drive circuit of the LED illumination device.

DESCRIPTION OF THE PREFERRED EMBODIMENTS

Figure 1:
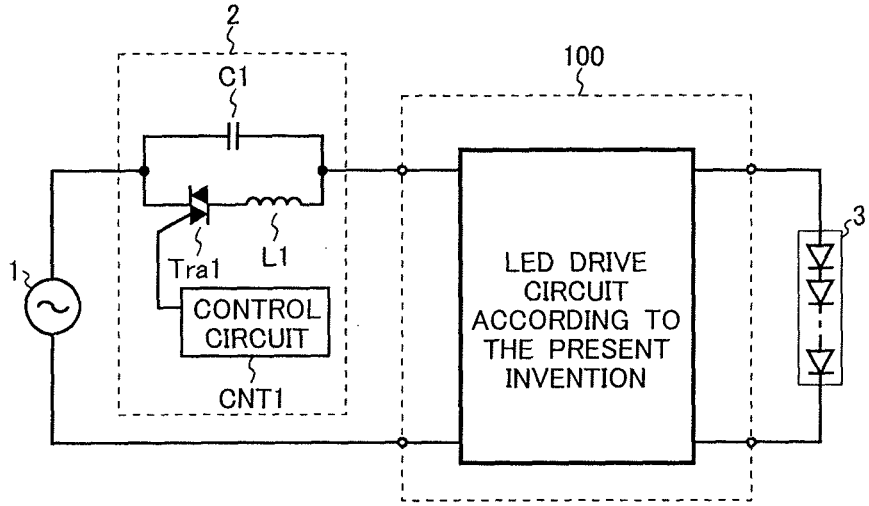
FIG. 1 is a view showing a structural example of an LED illumination system according to the present invention.

The embodiments of the present invention will be described below with reference to the drawings. A structural example of an LED illumination system according to the present invention is shown in FIG. 1. The LED illumination system according to the present invention shown in FIG. 1 includes: a phase-control light controller 2; an LED drive circuit 100 according to the present invention 100; and an LED module 3. In the LED illumination system according to the present invention shown in FIG. 1, an alternating-current power source 1, the phase-control light controller 2 and the LED drive circuit 100 according to the present invention are connected in series with each other. An anode and a cathode of the LED module 3 that includes one or more LEDs are connected to an output side of the LED drive circuit 100 according to the present invention.

Even if a TRIAC Tra1 is in an off state, a current that corresponds to a frequency (50 Hz or 60 Hz) of the alternating-current power source 1 flows from a capacitor C1 of a noise prevention circuit of the phase-control light controller 2 to the LED drive circuit 100 according to the present invention.

The LED drive circuit 100 according to the present invention includes a current remove portion (not shown) that removes a current from a current supply line that supplies an LED drive current to the LED module 3. If an input current to the LED drive circuit 100 according to the present invention is an unnecessary current, the LED module 3 does not light because of current removal by the current remove portion; if the input current to the LED drive circuit 100 according to the present invention turns into an LED drive current from an unnecessary current, the current removal portion decreases the amount of current removed. Here, the unnecessary current means a current that can be supplied to the LED module 3 and is unnecessary to the LED module 3 for a time span in which it is necessary to keep the LED module 3 from lighting; here, a leakage current from the capacitor C1 is an necessary current. The LED drive current means a current that is supplied to the LED module 3 for a time span in which it is necessary to keep the LED module 3 lighting.

If the input current to the LED drive circuit 100 according to the present invention is an unnecessary current, the LED module 3 does not light because of current removal by the current remove portion; accordingly, it is possible to prevent unnecessary lighting of the LED module 3 from occurring. Besides, if the input current to the LED drive circuit 100 turns into an LED drive current from an unnecessary current, the current remove portion decreases the amount of current removed; accordingly, it is possible to reduce the power loss and raise the power efficiency when the input current to the LED drive circuit 100 according to the present invention is an LED drive current.

Figure 2:
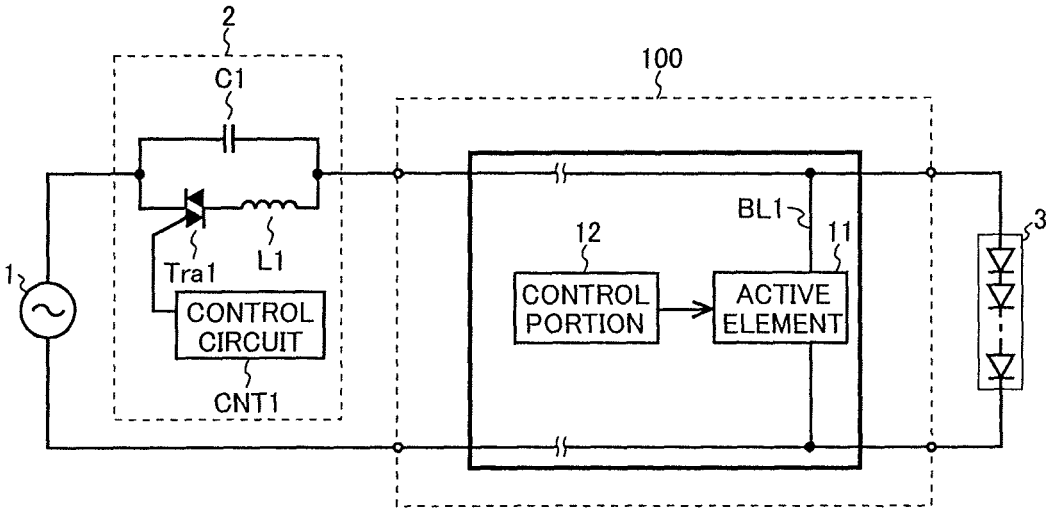
FIG. 2 is a view showing an embodiment of the LED illumination system shown in FIG. 1 according to the present invention.

Next, an embodiment of the LED illumination system shown in FIG. 1 according to the present invention is shown in FIG. 2. In the LED illumination system according to the present invention shown in FIG. 2, the current remove portion of the LED drive circuit 100 according to the present invention includes: a bypass line BL1 that carries a current which is removed from the current supply line; an active element 11 that is disposed on the bypass line BL1; and a control portion 12 that controls the active element 11. If the input current to the LED drive circuit 100 according to the present invention turns into an LED drive current from an unnecessary current, the control portion 12 switches the state of the active element 11 from an on state to an off state. Here, in FIG. 2, in the LED drive circuit 100 according to the present invention, although constituent components other than the current remove portion are not shown, the LED drive circuit 100 according to the present invention may include any constituent components.

In the LED illumination system according to the present invention shown in FIG. 2, if the input current to the LED drive circuit 100 according to the present invention turns into an LED drive current from an unnecessary current, the active element 11 is switched from the on state to the off state; accordingly, it is possible to prevent a current from flowing in the bypass line BL1. Because the control portion 12 generates a control signal for controlling the active element 11, a current that flows in the control portion 12 is much smaller than a current that flows in the bypass line BL1 when the active element 11 is in the on state. Accordingly, if the input current to the LED drive circuit 100 according to the present invention turns into an LED drive current from an unnecessary current, the current remove portion of the LED drive circuit 100 according to the present invention is able to decrease the amount of current removed.

Figure 3:
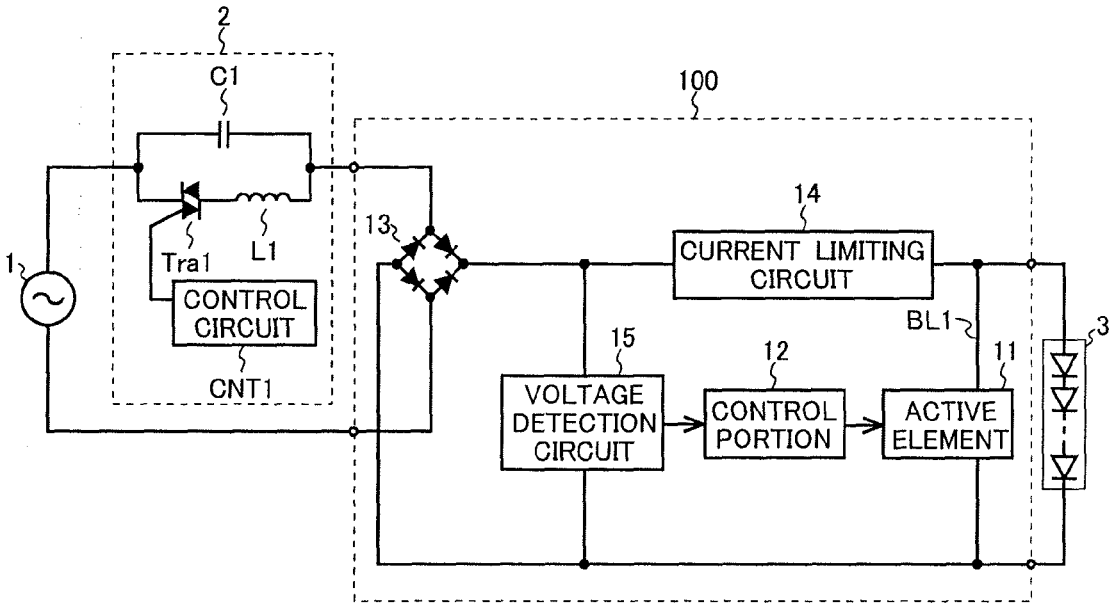
FIG. 3 is a view showing a first embodiment of the LED illumination system shown in FIG. 2 according to the present invention.

Next, a first embodiment of the LED illumination system shown in FIG. 2 according to the present invention is shown in FIG. 3. In the LED illumination system according to the present invention shown in FIG. 3, the LED drive circuit 100 according to the present invention includes: a bridge diode 13 that rectifies an input voltage to the LED drive circuit 100 according to the present invention; a current limiting circuit 14 that limits a current which flows in the LED module 3; and a voltage detection circuit 15 that detects an output voltage from the bridge diode 13. The voltage that is output from the alternating-current power source 1 and controlled in phase, that is, phase-controlled by the phase-control light controller 2 is rectified in full wave, that is, full-wave rectified by the bridge diode 13 and applied to the LED module 3 via the current limiting circuit 14. The control portion 12 performs on/off control of the active element 11 in accordance with a detection result from the voltage detection circuit 15.

Figure 4:
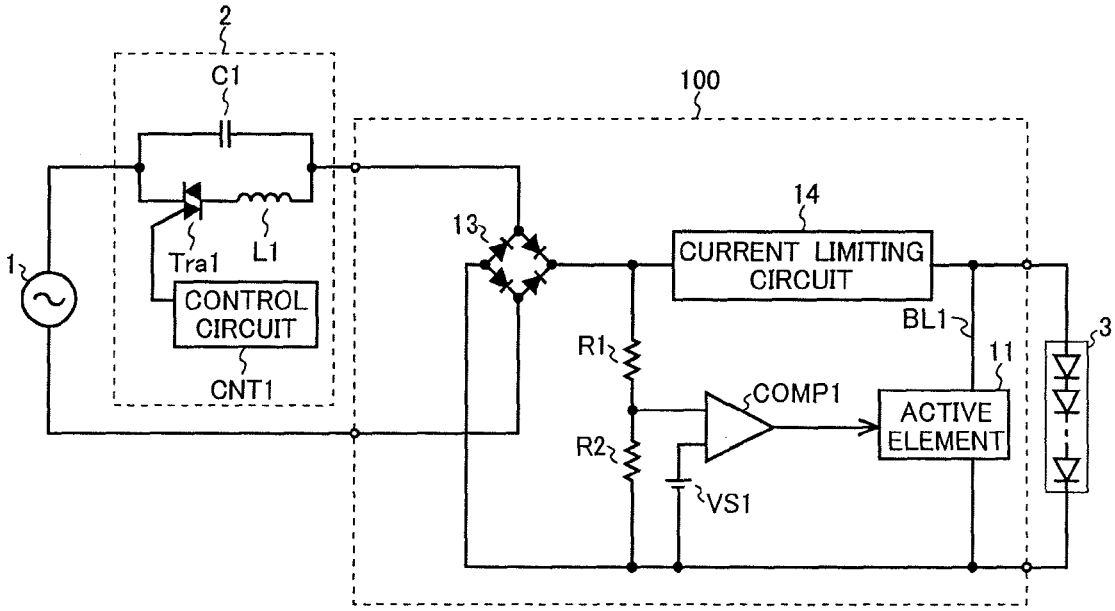
FIG. 4 is a view showing a specific example of the LED illumination system shown in FIG. 3 according to the present invention.

Next, a specific example of the LED illumination system according to the present invention shown in FIG. 3 is shown in FIG. 4. In FIG. 4, the voltage detection circuit 15 is composed of divided resistors R1 and R2; the control portion 12 is composed of a comparator COMP1 and a constant-voltage source VS1.

The comparator COMP1 compares a center-point voltage between the divided resistors R1 and R2 and a constant voltage output from the constant-voltage source VS1; holds the active element 11 in the on state for a time the center-point voltage between the divided resistors R1 and R2 is smaller than the constant voltage output from the constant-voltage source VS1; keeps the LED module 3 from lighting by preventing a leakage current from flowing in the LED module 3; and holds the active element 11 in the off state for a time the center-point voltage between the divided resistors R1 and R2 is equal to or larger than the constant voltage output from the constant-voltage source VS1, so that a current is prevented from flowing in the bypass line BL1.

By changing the resistance ratio of the divided resistors R1 and R2, it is possible to change the threshold voltage of the comparator COMP1 and also possible to change the on/off switch timing of the active element 11.

Figure 5:
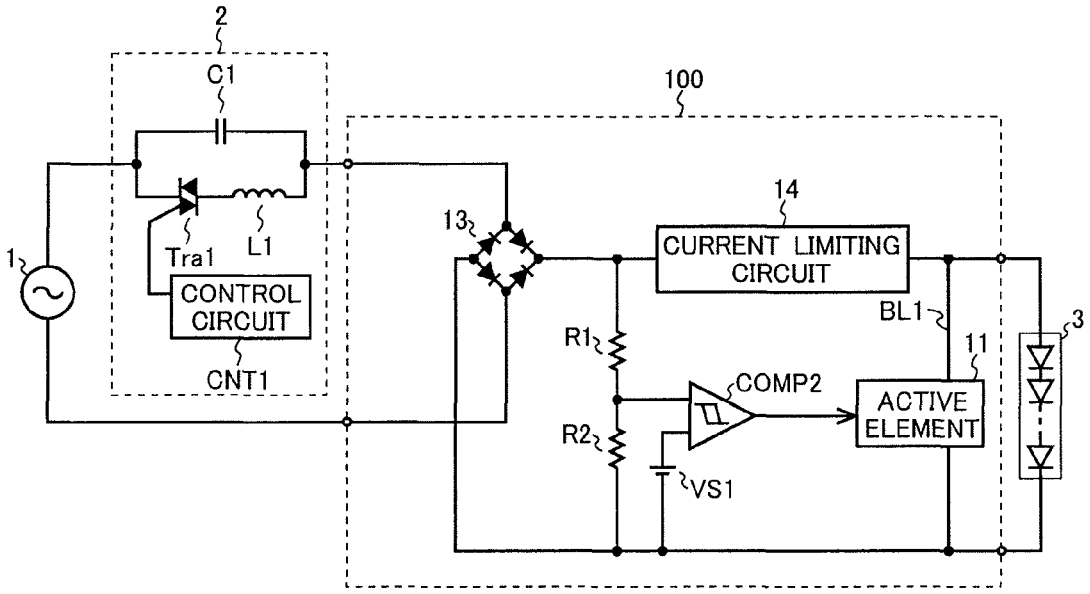
FIG. 5 is a view showing a structure in which a comparator of the LED illumination system shown in FIG. 4 according to the present invention is replaced with a comparator that has a hysteresis function.

The threshold voltage of the comparator COMP1 is equal in both cases: the state in which the center-point voltage between the divided resistors R1 and R2 is smaller than the constant voltage output from the constant-voltage source VS1 changes to the state in which the center-point voltage between the divided resistors R1 and R2 is larger than the constant voltage output from the constant-voltage source VS1; the state in which the center-point voltage between the divided resistors R1 and R2 is larger than the constant voltage output from the constant-voltage source VS1 changes to the state in which the center-point voltage between the divided resistors R1 and R2 is smaller than the constant voltage output from the constant-voltage source VS1. Accordingly, the active element 11 is sometimes turned on when the alternating voltage output from the alternating-current source 1 is decreasing from the peak 141 V to 0 V, so that a current which does not contribute to the lighting of the LED module 3 flows in the bypass line BL1. To avoid this, as shown in FIG. 5, a comparator COMP2 that has a hysteresis characteristic is used instead of the comparator COMP1; and the threshold voltage in the time the state in which the center-point voltage between the divided resistors R1 and R2 is larger than the constant voltage output from the constant-voltage source VS1 changes to the state in which the center-point voltage between the divided resistors R1 and R2 is smaller than the constant voltage output from the constant-voltage source VS1 is set to a voltage lower than the threshold voltage in the time the state in which the center-point voltage between the divided resistors R1 and R2 is smaller than the constant voltage output from the constant-voltage source VS1 changes to the state in which the center-point voltage between the divided resistors R1 and R2 is larger than the constant voltage output from the constant-voltage source VS1. Thus, it is possible to prevent the active element 11 from being turned on when the alternating voltage output from the alternating-current source 1 is decreasing from the peak 141 V to 0 V, and prevent a current which does not contribute to the lighting of the LED module 3 from flowing in the bypass line BL1, so that the power efficiency is able to be further increased.

Figure 6:
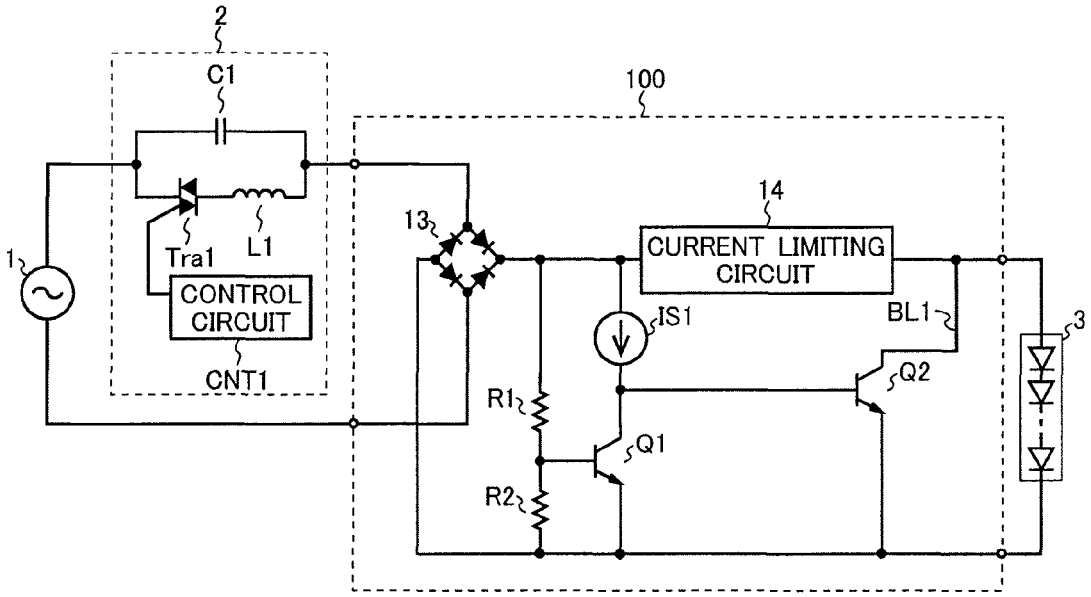
FIG. 6 is a view showing another specific example of the LED illumination system shown in FIG. 3 according to the present invention.

Another specific example of the LED illumination system shown in FIG. 3 according to the present invention is shown in FIG. 6. In FIG. 6, the voltage detection circuit 15 is composed of the divided resistors R1 and R2. The control portion 12 is composed of; a first transistor Q1 a base of which is connected to an output of the voltage detection circuit which is composed of the divided resistors R1 and R2; and a constant-current source IS1 that is connected to a collector of the transistor Q1. The active element 11 is used as a second transistor Q2.

Because the transistor Q1 is in an off state for a time the center-point voltage between the divided resistors R1 and R2 is smaller than the base-emitter voltage of the transistor Q1, the current from the constant-current source IS1 is supplied to the base of the transistor Q2 and the transistor Q2 is turned on. Thus, a leakage current does not flow in the LED module 3 and the LED module 3 does not light. On the other hand, because the transistor Q1 is in an on state for a time the center-point voltage between the divided resistors R1 and R2 is equal to or larger than the base-emitter voltage of the transistor Q1, the current from the constant-current source IS1 is not supplied to the base of the transistor Q2 and the transistor Q2 is turned off. Thus, a current does not flow in the bypass line BL1.

It is possible to change the on/off switch timing of the transistor Q2 by changing the resistance ratio of the divided resistors R1 and R2. Besides, if the collector-emitter voltage of the transistor Q2 is made sufficiently small by setting the constant-current value of the constant-current source IS1 and the h parameter $h_{FE}$ of the transistor Q2, it is possible to curb a delay in the rising voltage of the TRIAC Tra1.

Figure 7:
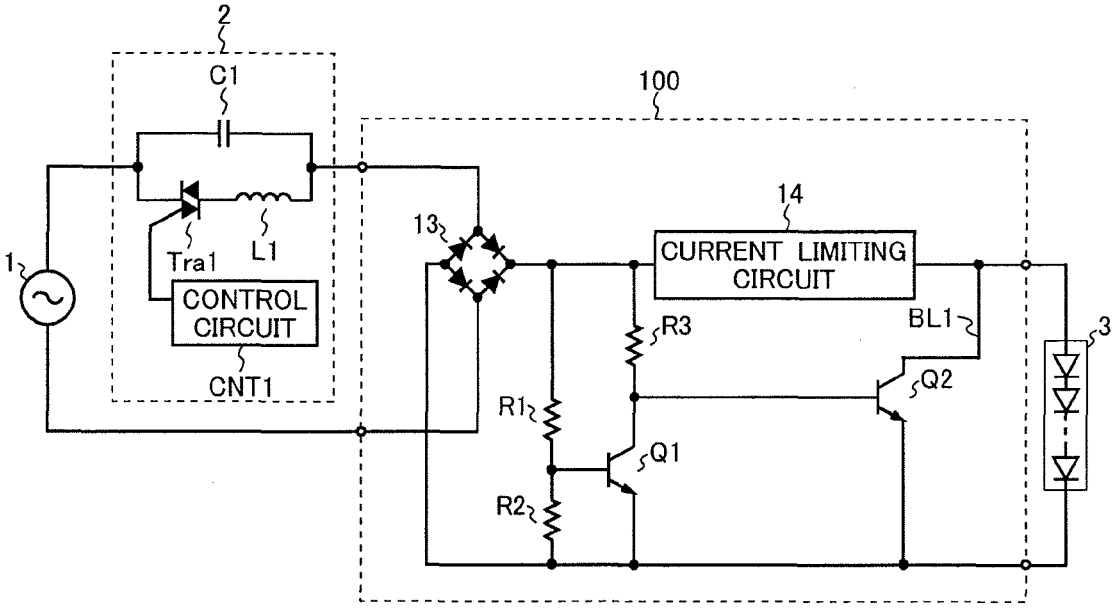
FIG. 7 is a view showing a structure in which a constant-current source of the LED illumination system shown in FIG. 6 according to the present invention is replaced with a resistor.

Besides, the constant-current source IS1 in the structure shown in FIG. 6 may be replaced with a resistor R3 into a structure shown in FIG. 7. The structure shown in FIG. 7 is able to achieve simplification and cost reduction of the control portion compared with the structure shown in FIG. 6.

Figure 8A:
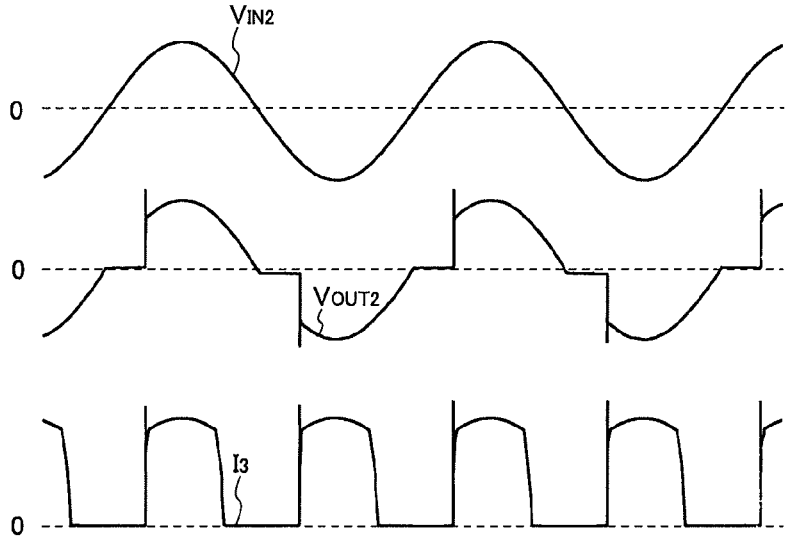
FIG. 8A is a view showing examples of operation waveforms in the specific examples shown in FIGS. 4 to 7.
Figure 8B:
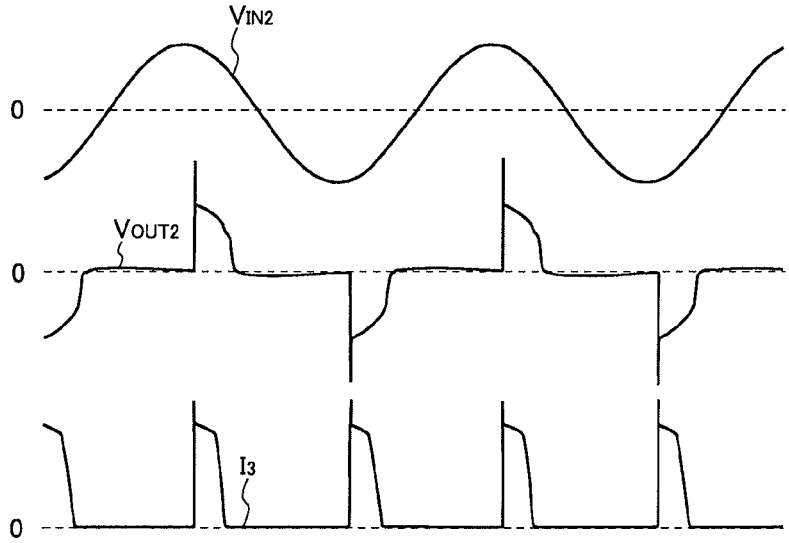
FIG. 8B is a view showing examples of operation waveforms in the specific examples shown in FIGS. 4 to 7.
Figure 8C:
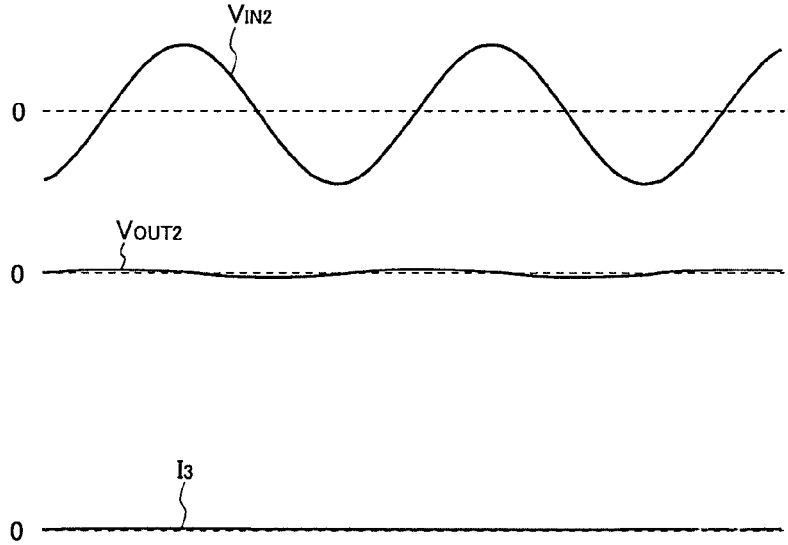
FIG. 8C is a view showing examples of operation waveforms in the specific examples shown in FIGS. 4 to 7.

Here, examples of operation waveforms in the specific examples shown in FIGS. 4 to 7 are shown in FIGS. 8A to 8C. In FIGS. 8A to 8C, $V_{IN2}$ is an input-voltage waveform to the phase-control light controller 2; $V_{OUT2}$ is an output-voltage waveform from the phase-control light controller 2; and $I_3$ is a current waveform that flows in the LED module 3. FIG. 8A shows waveforms at 100% light control (with no phase delay); FIG. 8B shows waveforms at half light control (with half phase delay); and FIG. 8C shows waveforms at 0% light control (with the maximum phase delay), that is, in the off state.

As is clear from FIGS. 8A to 8C, if the alternating-current power source 1, the phase-control light controller 2, and the LED drive circuit 100 according to the present invention are connected in series with each other, and the LED module 3 is driven, it is possible to perform the light control of the LED module 3 from 100% to 0% lighting with the phase-control light controller 2. And an unnecessary current is not contained in the current $I_3$ that flows in the LED module 3. Besides, even if the phase-control light controller 2 is replaced with a phase-control light controller 2' that has a firefly lighting function with a neon lamp, likewise, it is possible to perform the light control of the LED module 3 from 100% to 0% lighting with the phase-control light controller 2', and an unnecessary current is not contained in the current $I_3$ that flows in the LED module 3.

Figure 9:
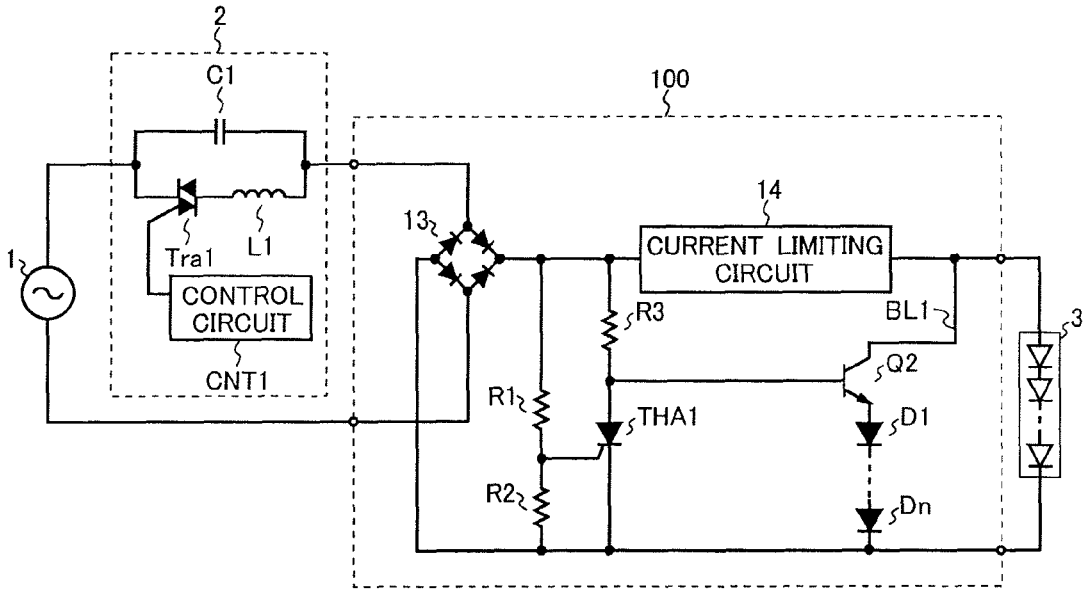
FIG. 9 is a view showing another specific example of the LED illumination system shown in FIG. 3 according to the present invention.

Next, a still another specific example of the LED illumination system shown in FIG. 3 according to the present invention is shown in FIG. 9. In FIG. 9, the voltage detection circuit 15 is composed of the divided resistors R1 and R2. The control portion 12 is composed of; a thyristor Tha1 a gate of which is connected to the output of the voltage detection circuit which is composed of the divided resistors R1 and R2; and the resistor R3 that is connected to an anode of the thyristor Tha1. The active element 11 is used as the second transistor Q2. Further, a plurality of diodes D1 to Dn that are connected to an emitter of the transistor Q2 are disposed on the bypass line BL1.

Because the thyristor Tha1 is in an off state for a time the center-point voltage between the divided resistors R1 and R2 is smaller than the gate voltage of the thyristor Tha1, the current that flows from the resistor R3, that is, the current source, is supplied to the base of the transistor Q2 and the transistor Q2 is turned on. Thus, a leakage current does not flow in the LED module 3 and the LED module 3 does not light. On the other hand, because the thyristor Tha1 is in an on state for a time the center-point voltage between the divided resistors R1 and R2 is equal to or larger than the gate voltage of the thyristor Tha1, the current that flows from the resistor R3, that is, the current source, is not supplied to the base of the transistor Q2 and the transistor Q2 is turned off. Thus, a current does not flow in the bypass line BL1.

Because the structure shown in FIG. 9 uses the thyristor Tha1 instead of the transistor Q1 in FIG. 6 or FIG. 7, it is possible to further curb the power loss and improve the power efficiency by using the thyristor Tha1. In other words, an output voltage (the collector-emitter voltage) from the transistor Q2 that is generated when the alternating voltage output from the alternating-current power source 1 is decreasing from the peak 141 V to 0V is curbed by a current hold function of the thyristor Tha1. Although the thyristor Tha1 goes into the on state at a trigger voltage like the transistor Q1, an on current keeps flowing for a half cycle of the alternating voltage output from the alternating-current power source 1 even if the trigger voltage is stopped. Accordingly, the base-emitter voltage of the transistor Q2 stays at a low level, so that the transistor Q2 is able to keep the off state.

The plurality of diodes D1 to Dn connected to the emitter of the transistor Q2 are an example for control of the transistor Q2 in which the emitter potential of the transistor Q2 is made higher than an on voltage (usually, about 1.4 V) of the thyristor Tha1 and the transistor Q2 is controlled by on/off of the thyristor Tha1. The emitter potential of the transistor Q2 may be made high by another method.

Figure 10:
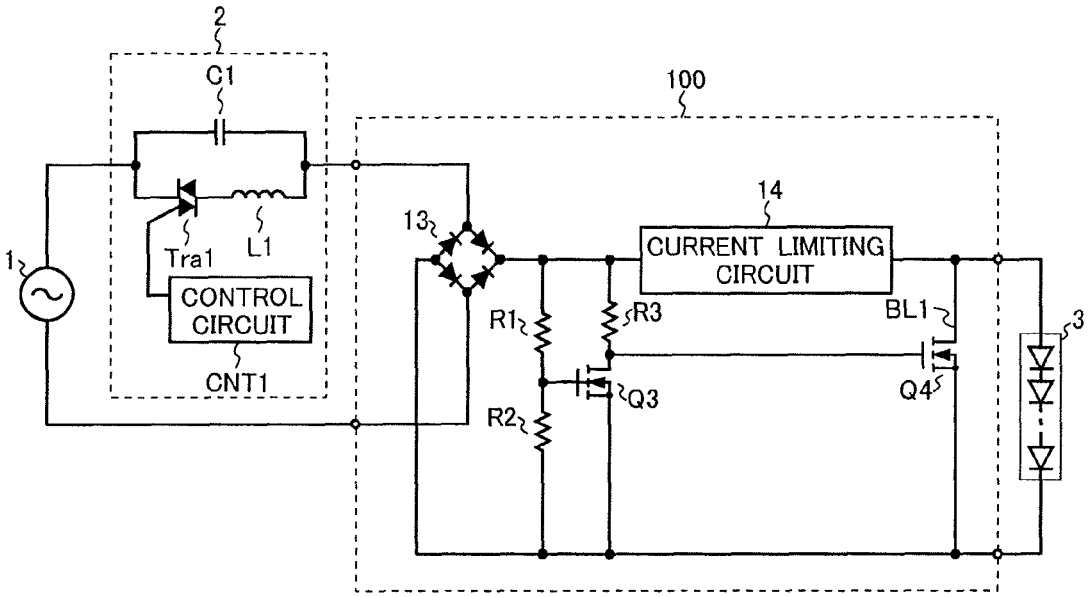
FIG. 10 is a view showing a specific example in which a MOS transistor is used in the LED illumination system shown in FIG. 3 according to the present invention.

Next, a specific example in which a MOS transistor is used in the LED illumination system shown in FIG. 3 according to the present invention is shown in FIG. 10. The structure shown in FIG. 10 is obtained by replacing the first transistor Q1 with a first N-channel MOS transistor Q3 and by replacing the second transistor Q2 with a second N-channel MOS transistor Q4 in the structure shown in FIG. 7, and the same function as that of the structure shown in FIG. 7 is achieved.

Figure 11:
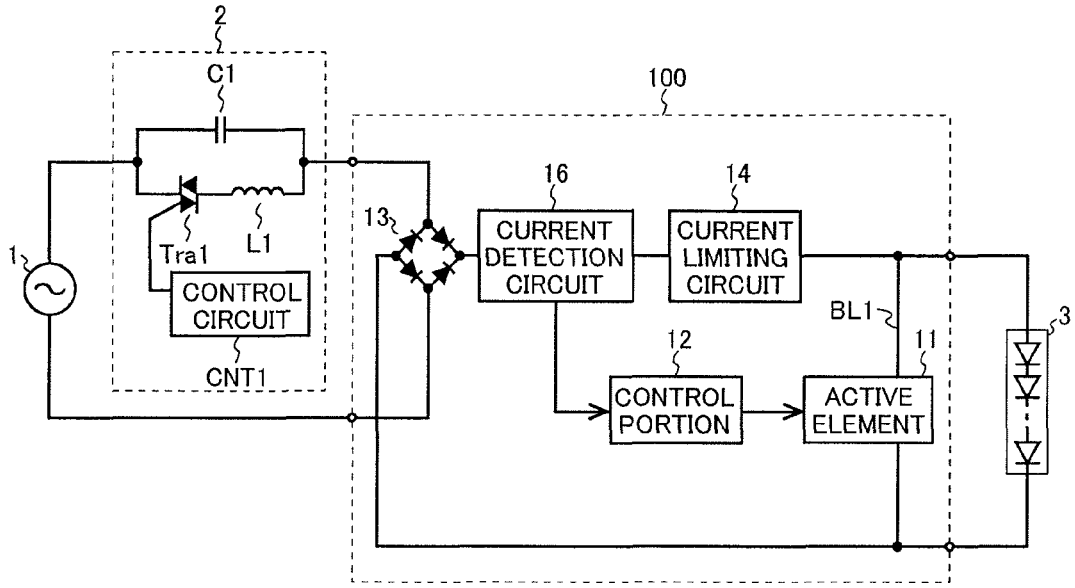
FIG. 11 is a view showing a second embodiment of the LED illumination system shown in FIG. 2 according to the present invention.
Figure 12:
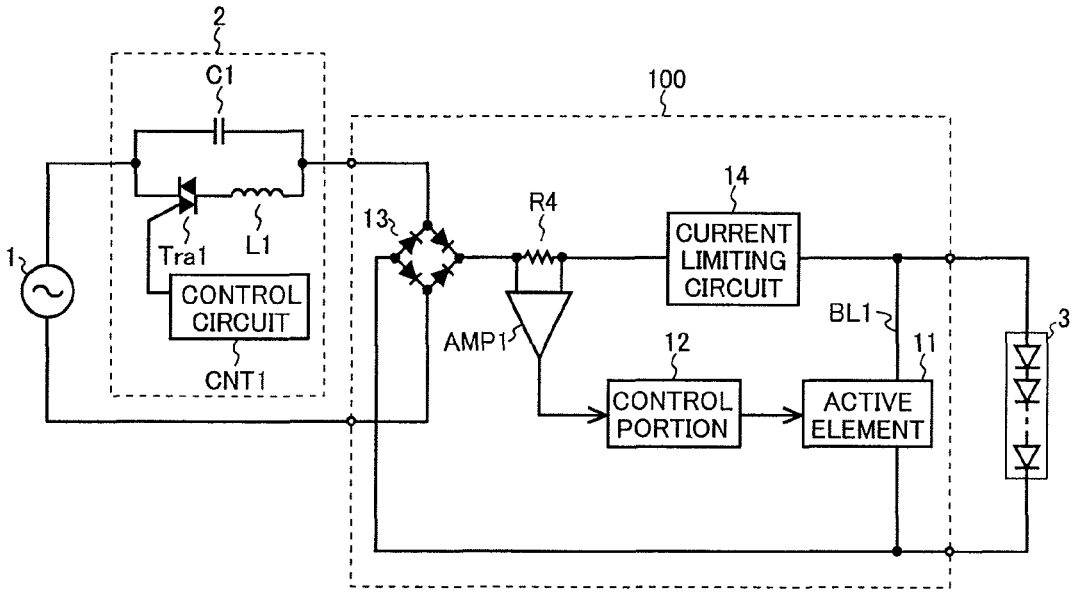
FIG. 12 is a view showing a specific example of the LED illumination system shown in FIG. 11 according to the present invention.

Next, a second embodiment of the LED illumination system shown in FIG. 2 according to the present invention is shown in FIG. 11. In the LED illumination system shown in FIG. 11 according to the present invention, the LED drive circuit 100 according to the present invention includes: the bridge diode 13 that rectifies the input voltage to the LED drive circuit 100 according to the present invention; the current limiting circuit 14 that limits a current which flows in the LED module 3; and a current detection circuit 16 that detects an output current from the bridge diode 13. The voltage that is output from the alternating-current power source 1 and controlled in phase, that is, phase-controlled by the phase-control light controller 2 is rectified in full wave, that is, full-wave rectified by the bridge diode 13 and applied to the LED module 3 via the current limiting circuit 14. The control portion 12 performs on/off control of the active element 11 in accordance with a detection result from the current detection circuit 16. As shown in FIG. 12, as an example of the current detection circuit 16, there is a current detection circuit that includes: a current detection resistor R4; and an error amplifier AMP1 that detects an voltage across both terminals of the current detection resistor R4. Here, as specific examples of the active element 11, the control circuit 12, and the current limiting circuit 14 in the second embodiment shown in FIG. 11, it is possible to use the specific examples of the active element 11, the control circuit 12, and the current limiting circuit 14 in the above first embodiment.

Unlike the type of the above LED illumination system, there is an LED illumination system of the type in which two LED modules the forward directions of which are different from each other are disposed; and lighting, light control, and on/off control are performed in a half cycle of an alternating current. This type has advantages that a bridge diode is unnecessary; the power efficiency is slightly increased because the bridge diode is unnecessary; and the life of the LED is prolonged (the light-flux decrease is eased) because the duty ratio of the LED drive current is half compared with the type of driving after full-wave rectification. However, on the other hand, there is a disadvantage that the cost increases because the number of LEDs is doubled.

Figure 13:
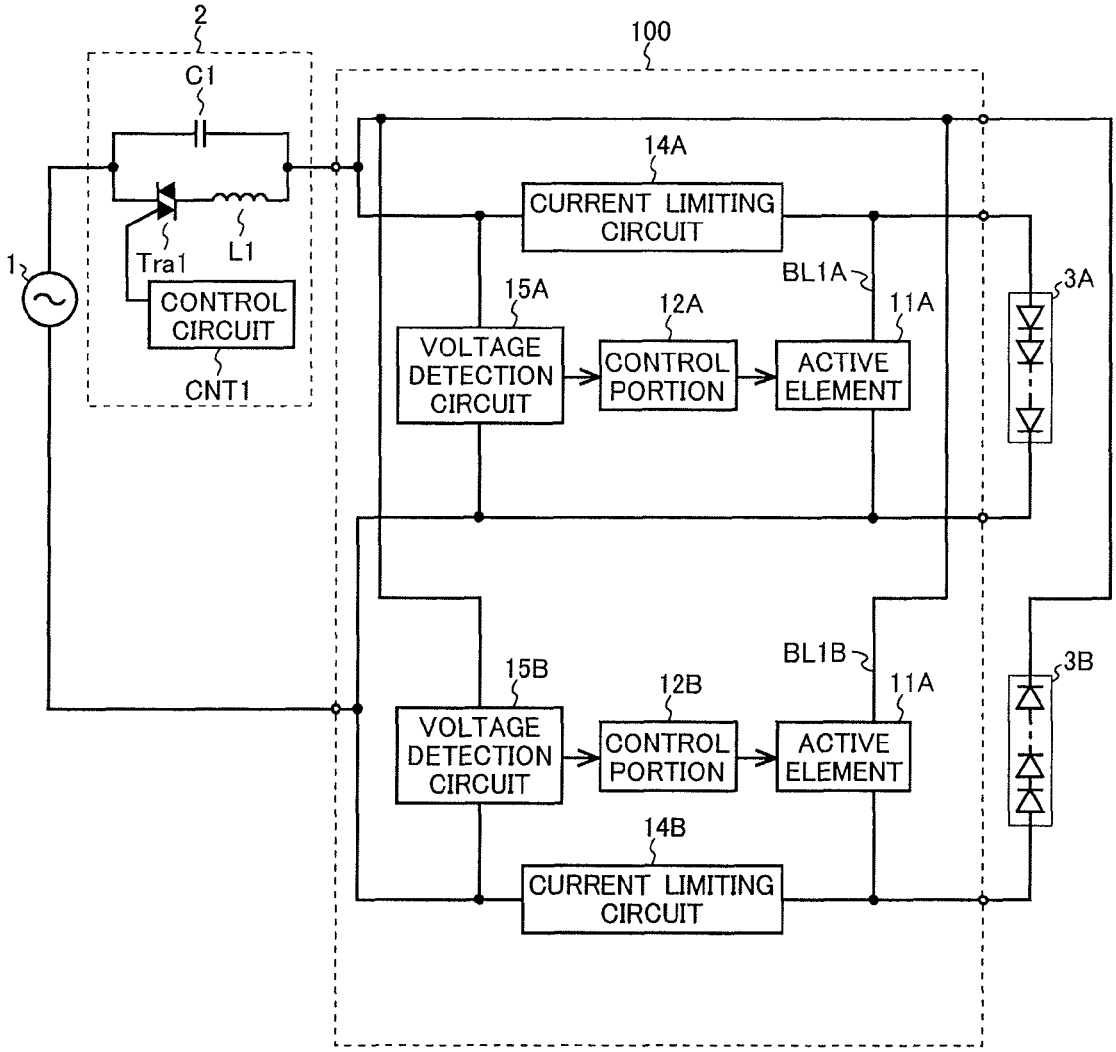
FIG. 13 is a view showing a structural example of an LED illumination system in which two LED modules that have forward directions different from each other are disposed.

A structural example of the LED illumination system according to the present invention in which two LED modules that have forward directions different from each other are disposed is shown in FIG. 13. Like in the structure shown in FIG. 3, in the structure shown in FIG. 13, included for an LED module 3A are: a bypass line BL1A; an active element 11A; a control portion 12A; a current limiting circuit 14A; and a voltage detection circuit 15A. Further, included for an LED module 3B are: a bypass line BL1B; an active element 11B; a control portion 12B; a current limiting circuit 14B; and a voltage detection circuit 15B. According to this, the illumination system is able to be driven without rectifying the alternating voltage like the illumination system shown in FIG. 3 according to the present invention.

Figure 14:
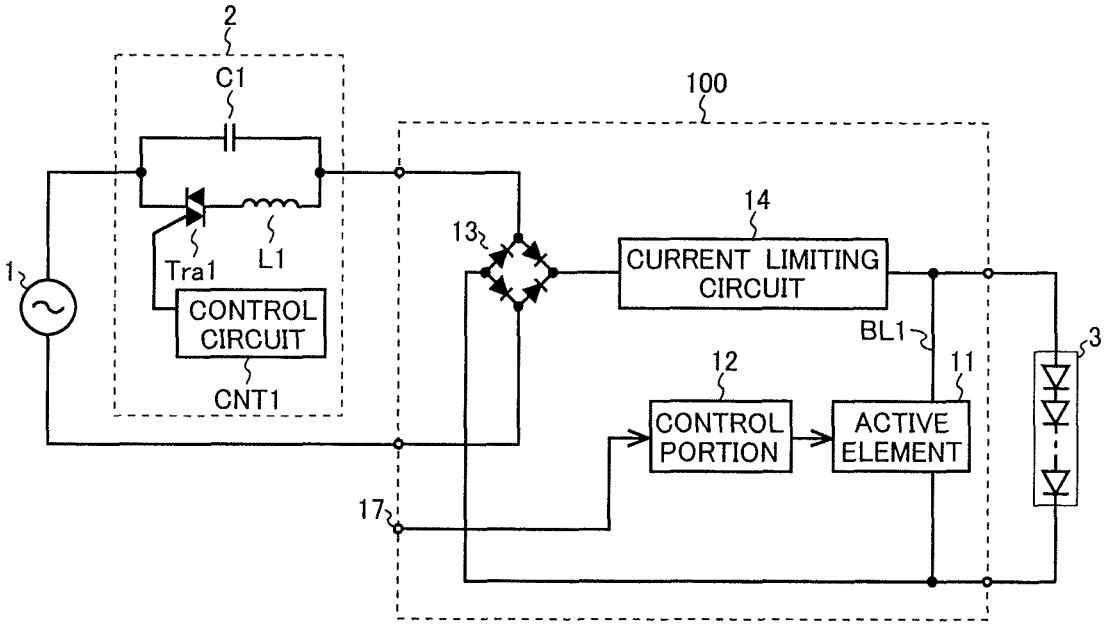
FIG. 14 is a view showing a structural example of an LED illumination system according to the present invention that includes an external signal input portion.

Next, a structural example of an LED illumination system according to the present invention that includes an external signal input portion is shown in FIG. 14. The structure shown in FIG. 14 is a structure that includes an external signal input terminal 17 instead of the voltage detection circuit 15 in the structure shown in FIG. 3; and the control portion 12 performs on/off control of the active element 11 in accordance with an external signal input to the external signal input terminal 17. The external signal is generated by a pulse generator such as a control circuit CNT1 or the like that is built in a simple microcomputer or a phase-control light controller, for example, and is supplied to the external signal input terminal 17. According to this type, it is possible to easily add additional functions such as a shutdown function to turn off the LED at an unusual time, a timer lighting function and the like.

The input voltage to the LED drive circuit according to the present invention is not limited to a commercial power-source voltage 100 V in Japan. If the circuit constants of the LED drive circuit according to the present invention are set to appropriated values, an overseas commercial power-source voltage or a decreased alternating voltage is able to be used as the input voltage to the LED drive circuit according to the present invention.

Besides, it is possible to provide a safer LED drive circuit by adding protective elements such as a current fuse and the like to the LED drive circuit according to the present invention.

In the above structure of the LED drive circuit, although the bypass line is disposed on a subsequent stage of the current limiting circuit, the bypass line may be disposed on a previous stage (the input side or the output side of the bridge diode) of the current limiting circuit. However, it is necessary to make sure that the active element disposed on the bypass line is not damaged by an unlimited current in the case where the bypass line is disposed on the previous stage (the input side or the output side of the bridge diode) of the current limiting circuit.

In the above structure (except the structure shown in FIG. 13) of the LED drive circuit, the current limiting circuit 14 is connected to the anode side of the LED module 3. However, there is no problem in connecting the current limiting circuit 14 to the cathode side of the LED module 3 if each circuit constant is suitably set.

Figure 15:
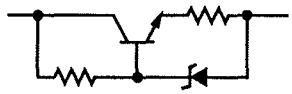
FIG. 15 is a view showing a structural example of a current limiting circuit.

The current limiting circuit 14 is a circuit portion that prevents a current equal to or larger than the rated current from flowing in the LED module. There are cases where the current is limited by only a passive element such as a resistor or the like or by a combination of a resistor and an active element such as a transistor or the like (e.g., the structure shown in FIG. 15).

Besides, if the current flowing in the LED module 3 has a sufficient margin with respect to the rated current of the LED, there in no influence on the light control operation and the like even if the light limiting circuit 14 is not disposed.

Figure 16:
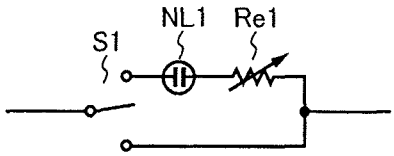
FIG. 16 is a view showing a light controller that includes a switch and a firefly circuit.

Instead of the phase-control light controller 2 and the phase-control light controller 2' that has the firefly lighting function with the neon lamp, even if a light controller other than the phase-control light controller 2 and the phase-control light controller 2' that has the firefly lighting function with the neon lamp, for example, a light controller shown in FIG. 16 that includes a switch S1 and a firefly circuit (a series circuit of a neon lamp NL1 and a current limiting circuit Re1) is disposed, the LED drive circuit according to the present invention is effective, and in this case as well, it is possible to prevent unnecessary lighting from occurring and improve the power efficiency.

The input voltage to the LED drive circuit according to the present invention is not limited to a voltage based on a sinusoidal alternating voltage, and another alternating voltage may be used.

Figure 17:
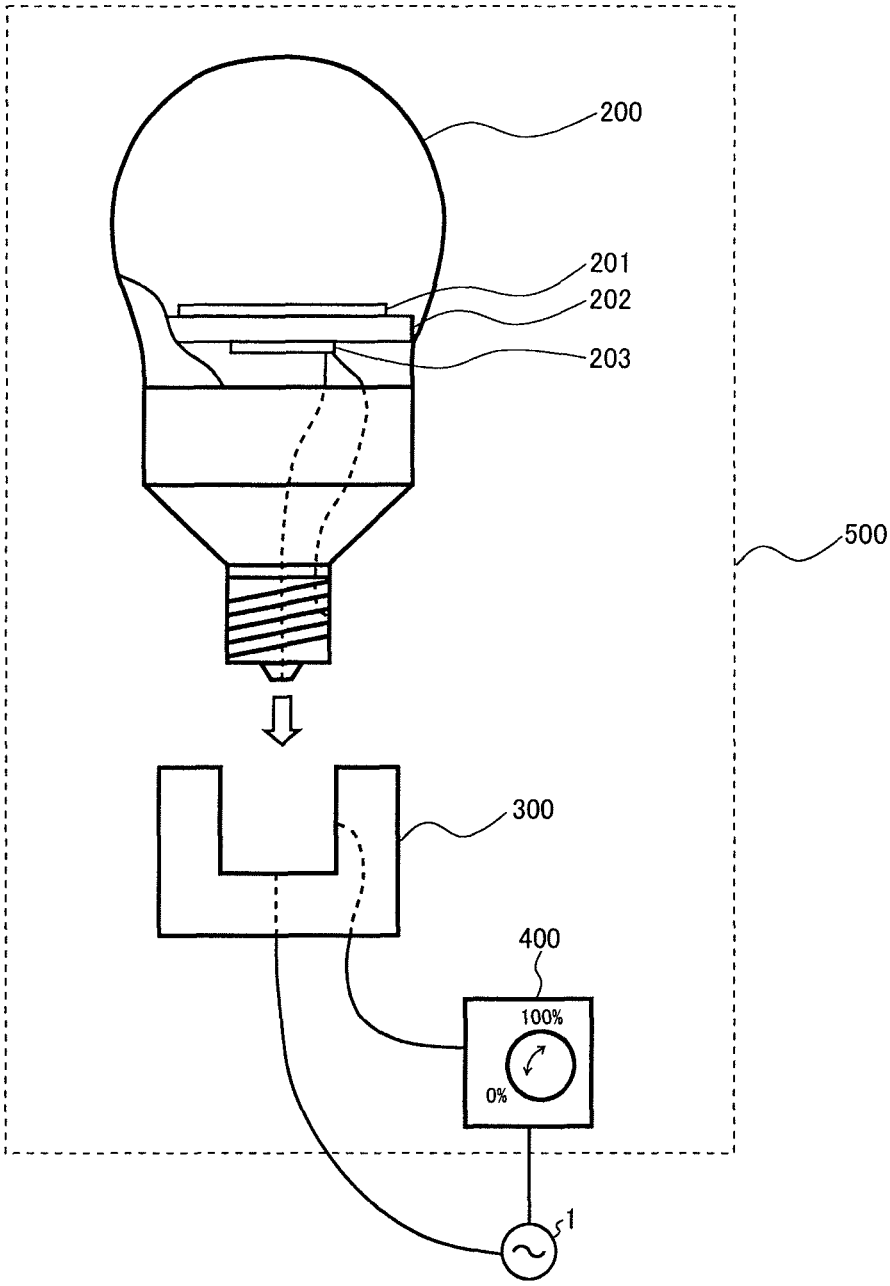
FIG. 17 is a view showing a schematic structural example of an LED illumination component according to the present invention.

Finally, a schematic structure of an LED illumination component according to the present invention is described. A schematic structural example of the LED illumination component according to the present invention is shown in FIG. 17. In FIG. 17, a partially cutaway view showing a bulb-shaped LED illumination component 200 according to the present invention is illustrated. The bulb-shaped LED illumination component 200 according to the present invention includes inside thereof: a housing or a board 202; an LED module 201 that includes one or more LEDs disposed on a front surface (a head side of the bulb shape) of the housing or the board 202; and a circuit 203 disposed on a rear surface (a lower side of the bulb shape) of the housing or the board 202. As the circuit 203, the above LED drive circuit 100 according to the present invention is able to be used. The circuit 203 is not limited to the above LED drive circuit 100 according to the present invention, and of course, a circuit that includes at least a circuit (a lighting prevention circuit) which has a function to prevent the LED from lighting because of an unnecessary current and further has even a power loss curb function to curb power loss due to the lighting prevention circuit may be used.

An LED illumination component mount portion 300 into which the bulb-shaped LED illumination component 200 according to the present invention is screwed and mounted and a controller 400 are connected in series with the alternating-current power source 1. An LED illumination device (a ceiling light, a pendant light, a kitchen light, a downlight, a stand light, a spot light, a foot light or the like) is composed of the bulb-shaped LED illumination component 200 according to the present invention and the LED illumination component mount portion 300. And, an LED illumination system 500 according to the present invention is composed of the bulb-shaped LED illumination component 200 according to the present invention, the LED illumination component mount portion 300, and the light controller 400. The LED illumination component mount portion 300 is disposed on a ceiling wall, for example, of a room, and the light controller 400 is disposed on a side wall, for example, of a room.

Because the bulb-shaped LED illumination component 200 according to the present invention is detachably mounted on the LED illumination component mount portion 300, for example, in an existing illumination device and an illumination system that conventionally use an illumination component such as an incandescent lamp, a fluorescent lamp or the like, it is possible to prevent the LED from lighting because of an unnecessary current by only replacing the illumination component such as the incandescent lamp, the fluorescent lamp or the like with the bulb-shaped LED illumination component 200 according to the present invention.

In FIG. 17, an appearance of the light controller 400 in a case where the light controller 400 is the light controller 2 in FIG. 1 is shown. In other words, the lighting degree is able to be adjusted by a knob-type volume. If the light controller 400 has the structure shown in FIG. 16, on the appearance of the light controller 400, a push-button switch that corresponds to the external switch S1, for example, rather than the knob-type volume is seen.

In the above description, as the light controller 400, a controller that is directly operated by a person with the knob-type volume or the push-button switch is described. However, this is not limitation and a controller such as a remote controller or the like that is remotely operated by a person with a radio signal may be employed. Specifically, a radio signal reception portion is disposed on the light-controller main body, that is, a reception side, and a radio signal transmission portion that sends light control signals (e.g., a dimming signal, a light on/off signal and the like) to the radio signal reception portion of the light-control main body is disposed on a transmitter main body (e.g., a remote-control transmitter, a mobile terminal or the like), that is, a transmission side, so that remote operation is possible.

Figure 18:
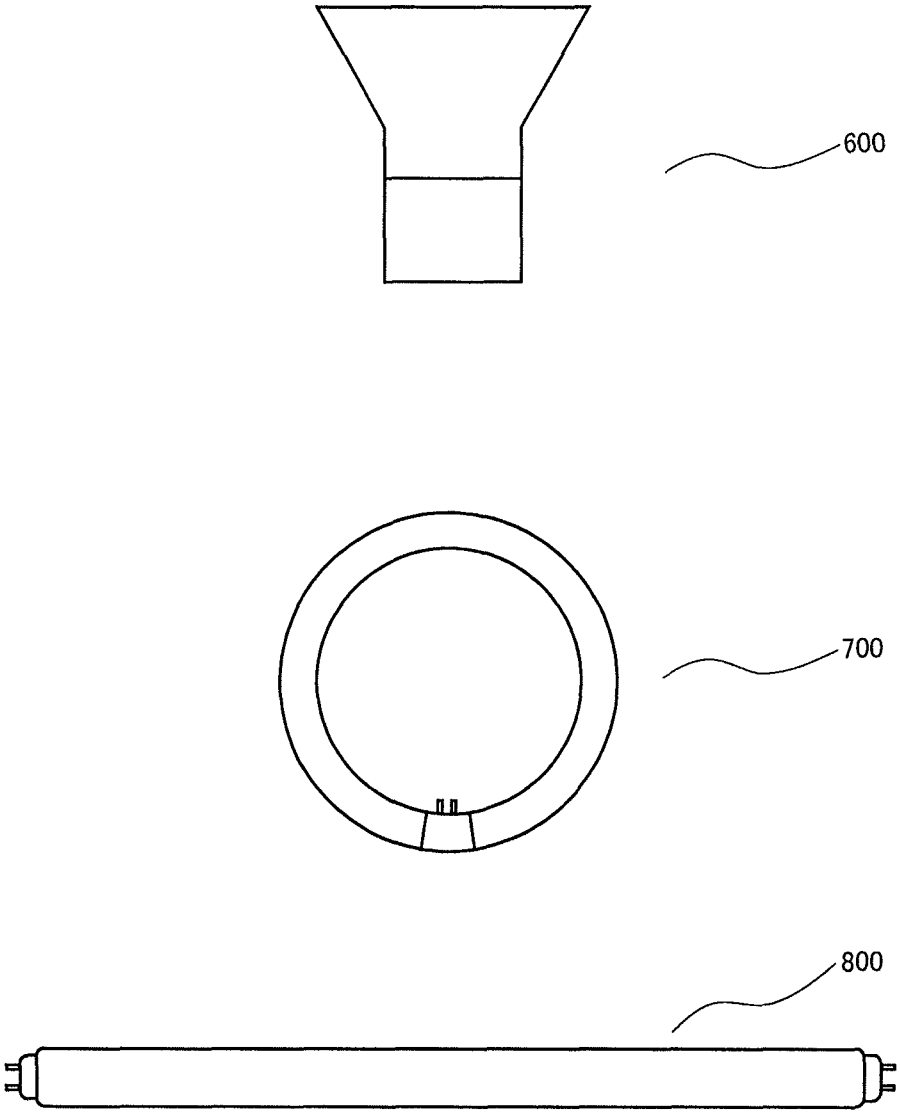
FIG. 18 is a view showing another schematic structural example of an LED illumination component according to the present invention.
Figure 19:
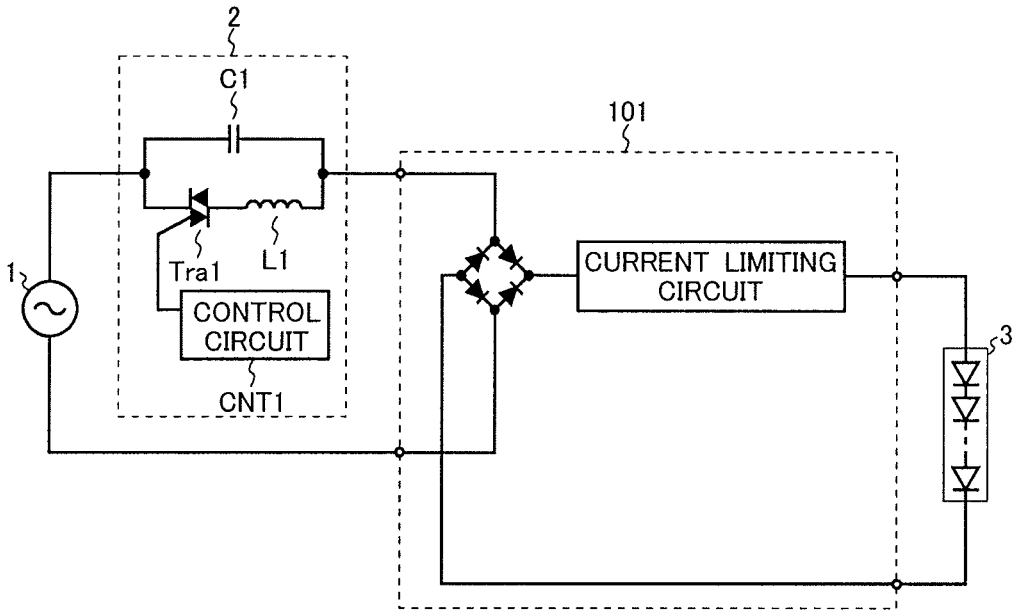
Prior Art Fig. 19
FIG. 19 is a view showing a conventional example of an LED illumination system that is able to perform light control of an LED illumination component which uses an alternating-current power source.
Figure 20A:
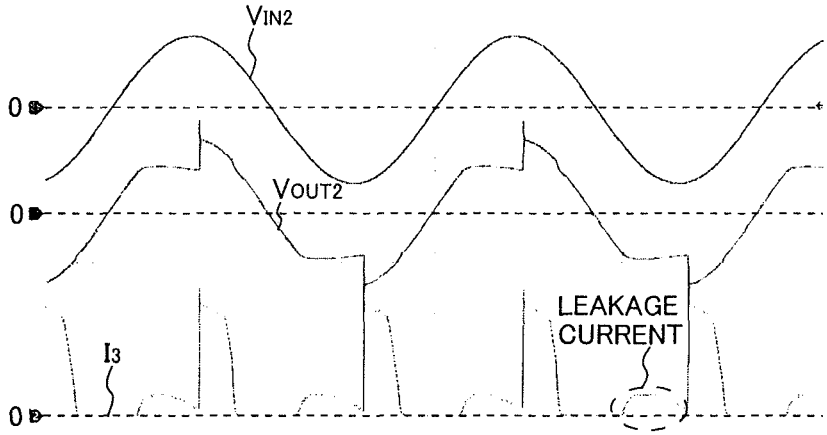
Prior Art Fig. 20A
FIG. 20A is a view showing waveforms of an input voltage to a phase-control light controller and a current that flows in an LED.
Figure 20B:
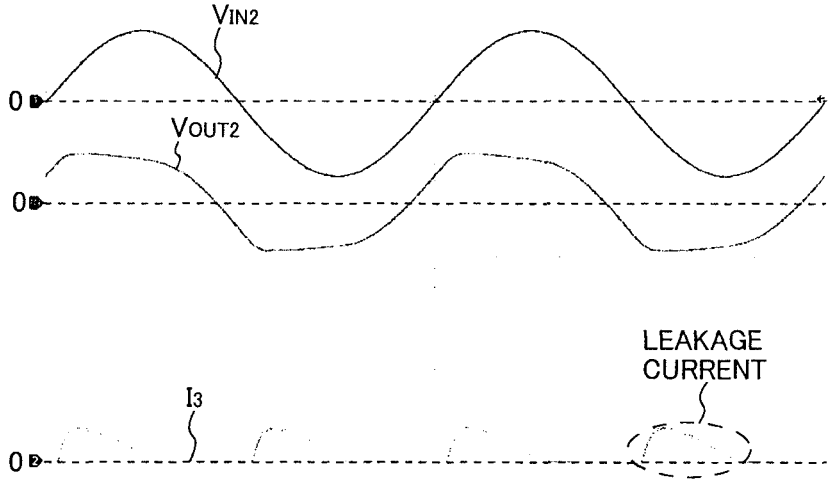
Prior Art Fig. 20B
FIG. 20B is a view showing waveforms of an input voltage to a phase-control light controller and a current that flows in an LED.
Figure 21:
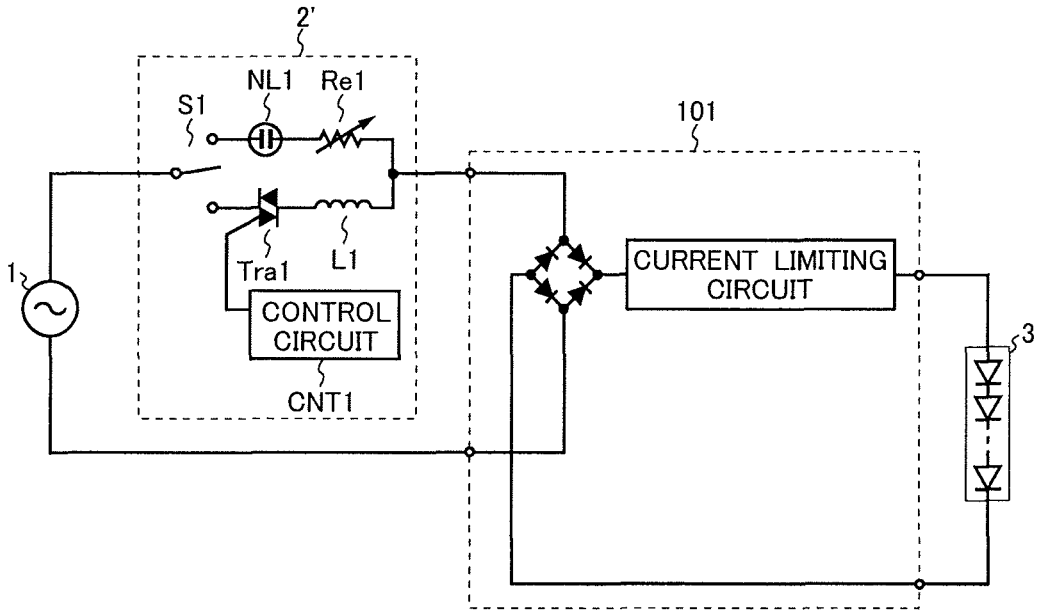
Prior Art Fig. 21
FIG. 21 is a view showing another conventional example of an LED illumination system that is able to perform light control of an LED illumination component which uses an alternating-current power source.
Figure 22:
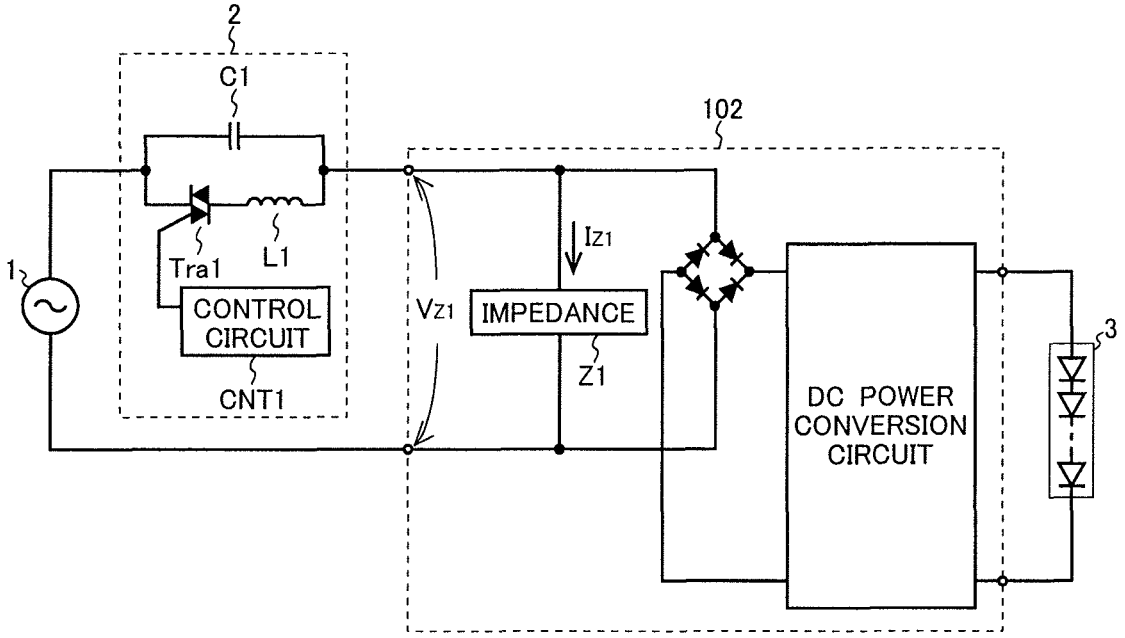
Prior Art Fig. 22
FIG. 22 is a view showing a conventional example of an LED illumination system that includes a means for curbing an unnecessary current that flows in an LED.

Besides, the LED illumination component according to the present invention is not limited to the bulb-shaped LED illumination component, and for example, a flashlight-shaped LED illumination component 600, an annular-shaped LED illumination component 700, or a linear tube-shaped LED illumination component 800 that are shown in FIG. 18 may be employed. Even if any shape is employed, the LED illumination component according to the present invention includes inside thereof: an LED; and a circuit (a lighting protection circuit) that has a function to prevent the LED from lighting because of an unnecessary current. Besides, it is desirable to dispose a circuit inside that has a power loss curb function as well to curb power loss due to the lighting prevention circuit.

What is claimed is:

1. An LED drive circuit that is directly or indirectly connected to an alternating voltage source via a light controller which is connectable between the alternating voltage source and the LED drive circuit, comprising:

a current supply line that supplies an LED drive current from the light controller to an LED; and a current remove portion that removes an unnecessary current, which is from the light controller, from the current supply line, and which is a current that is smaller than the LED drive current; wherein in the current remove portion, if an input current to the LED drive circuit is the unnecessary current, the unnecessary current is removed by current removing of the current remove portion; and if the input current to the LED drive circuit turns into the LED drive current from the unnecessary current, the current remove portion decreases the amount of current removed.

2. An LED illumination component comprising:

the LED drive circuit according to claim 1; and an LED connected to an output side of the LED drive circuit.

3. An LED illumination device comprising:

the LED illumination component according to claim 2.

4. An LED illumination system comprising:

the LED illumination component according to claim 2; and a light controller connected to an input side of the LED illumination component.

5. An LED illumination system comprising:

the LED illumination device according to claim 3; and a light controller connected to an input side of the LED illumination device.

* * * * *